US012559810B2

(12) United States Patent
Gao

(10) Patent No.: US 12,559,810 B2
(45) Date of Patent: Feb. 24, 2026

(54) S32750 AUSTENITIC FERRITE SUPER DUPLEX STAINLESS STEEL SEAMLESS PIPE FOR DEEP SEA MANIFOLD AND METHOD FOR PREPARING SAME

(71) Applicant: Shengtak New Materials Co., Ltd., Jiangsu (CN)

(72) Inventor: Hong Gao, Jiangsu (CN)

(73) Assignee: SHENGTAK NEW MATERIALS CO., LTD, Changzhou (CN)

( * ) Notice: Subject to any disclaimer, the term of this patent is extended or adjusted under 35 U.S.C. 154(b) by 460 days.

(21) Appl. No.: 18/058,879

(22) Filed: Nov. 28, 2022

(65) Prior Publication Data

US 2023/0167520 A1 Jun. 1, 2023

(30) Foreign Application Priority Data

Nov. 29, 2021 (CN) ..... 202111429249.0

(51) Int. Cl.

| | |
|---|---|
| ***C21D 8/10*** | (2006.01) |
| ***C21D 9/08*** | (2006.01) |
| ***C22C 33/04*** | (2006.01) |
| ***C22C 38/00*** | (2006.01) |
| ***C22C 38/06*** | (2006.01) |
| ***C22C 38/44*** | (2006.01) |

(52) U.S. Cl.

CPC ..... *C21D 8/105* (2013.01); *C21D 9/08* (2013.01); *C22C 33/04* (2013.01); *C22C 38/001* (2013.01); *C22C 38/06* (2013.01); *C22C 38/44* (2013.01); *C21D 2211/001* (2013.01); *C21D 2211/005* (2013.01)

(58) Field of Classification Search

CPC ..... C21D 2211/001; C21D 2211/005; C21D 6/004; C21D 6/005; C21D 8/0226; C21D 8/105; C21D 9/08; C22C 33/04; C22C 38/40; C22C 38/08; C22C 38/02; C22C 38/04; C22C 38/06; C22C 38/44

See application file for complete search history.

(56) References Cited

U.S. PATENT DOCUMENTS

2005/0158201 A1* 7/2005 Park ..... C22C 38/005 420/47

2010/0034689 A1* 2/2010 Hirata ..... C22C 38/52 420/49

* cited by examiner

*Primary Examiner* — Jie Yang

(57) ABSTRACT

Disclosed in the present disclosure is an S32750 austenitic ferrite super duplex stainless steel seamless pipe for a deep sea manifold and a method for preparing the same. The stainless steel seamless pipe includes the following components in percentage by mass: less than or equal to 0.03% of C, less than or equal to 0.80% of Si, less than or equal to 1.20% of Mn, less than or equal to 0.035% of P, less than or equal to 0.01% of S, 24.0-26.0% of Cr, 6.0-8.0% of Ni, 3.0-5.0% of Mo, less than or equal to 0.50% of Cu, 0.24-0.32% of N, 0.012-0.018% of Al, and the balance of Fe and impurities. The ferrite content of the stainless steel seamless pipe is 40-60%, and 41≤PREN<45. The stainless steel seamless pipe is prepared by metal collaborative design, smelting, pouring, forging, hot piercing and cold working.

6 Claims, 2 Drawing Sheets

S32750 AUSTENITIC FERRITE SUPER DUPLEX STAINLESS STEEL SEAMLESS PIPE FOR DEEP SEA MANIFOLD AND METHOD FOR PREPARING SAME

CROSS-REFERENCE TO RELATED APPLICATION

The present application claims priority from Chinese Patent Application No. 202111429249.0 filed on Nov. 29, 2021, the contents of which are incorporated herein by reference in their entirety.

BACKGROUND OF THE INVENTION

1. Technical Field

The present disclosure relates to the field of metal smelting, in particular to an S32750 austenitic ferrite super duplex stainless steel seamless pipe for a deep sea manifold and a method for preparing the same.

2. Description of Related Art

With the improvement of the exploitation ability of oil and gas resources in China, the development of domestic offshore oil and gas industry is greatly promoted. Compared with onshore oil and gas production systems, underwater production systems have higher integration level, stronger specialty and larger technical difficulty. With the gradual transformation of independent exploration and development of oil and gas fields from shallow sea to deep sea in China, China preliminarily has the ability to explore and develop deep-water oil and gas. However, the offshore oil and gas development in China started late, is still in the primary stage of deep-sea oil and gas, and lags far behind the foreign advanced level. A deep-water central manifold, as a core key component of a deep-water gas field production and operation system, works in underwater high-pressure and harsh chloride corrosion environments and is required to be free of maintenance within 30 years. These use characteristics determine that the piping for the deep-water central manifold certainly has high strength, high toughness, fatigue resistance, good weldability, seawater corrosion resistance and good cold workability. For the manufacturing engineering of underwater central manifold products in deep-sea oil and gas field development projects, the underwater central manifold was built in China for the first time, and an S32750 super austenitic ferrite duplex stainless steel seamless pipe in the manifold was purchased in China for the first time.

The S32750 super austenitic ferrite duplex stainless steel seamless pipe for a deep sea manifold has a maximum design pressure of 69 Mpa, and is composed of steel pipes with four specifications of Φ21.3 mm*2.77 mm, Φ26.7 mm*2.87 mm, Φ33.4 mm*4.55 mm and Φ60.3 mm*8.74 mm. The product has a small specification, is required to have good resistance to pitting and crevice corrosion, has good mechanical properties, and is adapted to underwater harsh seawater application medium environments in deep sea. High requirements are put forward for process technologies, such as metal component optimization, smelting process, hot piercing process, cold rolled pipe process and solution heat treatment process, during manufacturing. As a key pressure bearing pipe of the deep-water central manifold, the domestic manufacturing of the pipe of the present disclosure is of great significance for ensuring deep-sea oil and gas development.

BRIEF SUMMARY OF THE INVENTION

The main technical problem to be solved by the present disclosure is to provide an S32750 austenitic ferrite super duplex stainless steel seamless pipe for a deep sea manifold and a method for preparing the same, which can ensure that the S32750 austenitic ferrite super duplex stainless steel seamless pipe for a deep sea manifold has high purity, good surface quality, good strength and toughness, excellent pitting corrosion resistance and no harmful precipitated phase, and can be adapted to harsh corrosion environments.

In order to solve the above technical problem, a technical solution used by the present disclosure is to provide an S32750 austenitic ferrite super duplex stainless steel seamless pipe for a deep sea manifold, comprising the following components in percentage in mass: less than or equal to 0.03% of C, less than or equal to 0.80% of Si, less than or equal to 1.20% of Mn, less than or equal to 0.035% of P, less than or equal to 0.01% of S, 24.0-26.0% of Cr, 6.0-8.0% of Ni, 3.0-5.0% of Mo, less than or equal to 0.50% of Cu, 0.24-0.32% of N, 0.012-0.018% of Al, and the balance of Fe and impurities. The ferrite content of the S32750 austenitic ferrite super duplex stainless steel seamless pipe for a deep sea manifold is 40-60%, and 41≤PREN (pitting resistance equivalent number)<45.

In order to solve the above technical problem, another technical solution used by the present disclosure is to provide a method for preparing the S32750 austenitic ferrite super duplex stainless steel seamless pipe for a deep sea manifold, comprising the following steps: a: optimization of metal components and collaborative design of two-phase ratio and PREN of steel: adjusting a two-phase ratio by adjusting the contents of ferrite and austenite elements, the content of N in the steel being 0.26-0.32%, balancing the two-phase ratio and the PREN by the content of the N element, and at the same time, enabling a formation rate and a precipitation volume of a σ phase to gradually decrease until disappear; b: smelting of high-purity austenitic ferrite duplex stainless steel: first, performing primary smelting in an electric arc furnace (EAF) to remove impurities such as P, S and O in the steel, and adjusting the temperature of molten steel to obtain the specified components; then, performing Al powder enhanced deoxidization in smelting in an argon oxygen decarburization (AOD) furnace to control the Al content to 0.012-0.018%, and reduce the oxygen content to 11-25 ppm; finally, introducing relatively weak argon in refining outside a ladle furnace (LF), and performing stirring to remove small-size inclusions by bubbles; c: pouring: calculating a liquidus temperature of molten steel of S32750 stainless steel, and reasonably controlling an overheating degree of pouring; controlling a solidification process by controlling a temperature field so as to effectively control macro segregation and interdendritic segregation; d: forging: under the guidance of physical metallurgy principles and analog simulation, using natural gas heating and forging technologies to eliminate forging σ phase precipitation and phase size refinement by coupling control of a full-size temperature field and a strain field of a forged piece, so as to obtain a pipe billet with a coordinated two-phase ratio, a yield ratio not higher than 0.9 and a hardness (HRC) less than or equal to 28; e: hot piercing: heating the pipe billet by a sloping hearth heating furnace at a heating temperature of 1150-1200° C. for 150-290 min, then, performing heat preservation for 15-50 min, after heat preservation and soaking, piercing and rolling each round steel bar by a cross piercer with a large grinding angle to obtain a pierced billet, and subsequently, performing softening at an intermediate solution heat treatment temperature; and f: cold working: manufacturing a steel pipe mainly by cold rolling supplemented with cold drawing by using a cold rolling mill for controlling deformation, implementing solution heat treatment, and controlling a temperature and a time to manufacture a steel pipe with the same grain size as a finished product.

In a preferred embodiment of the present disclosure, in step b, 3 or 5 mm deoxidization aluminum shots with an Al content of greater than or equal to 99.7% are added to the AOD furnace to ensure the deoxidization amount of the steel; after Al deoxidization, the deoxidized product exists in the molten steel in the form of $Al_2O_3$ inclusions, and then, the refining slag is optimized; high-Al alkaline refining slag comprises the following components: 55-70% of CaO, 10-20% of $SiO_2$, and 15-20% of $Al_2O_3$; floating inclusions are adsorbed to reduce the content of the $Al_2O_3$ inclusions in the steel; and calcium is added to the molten steel to change the morphology of $Al_2O_3$ in the molten steel, hard and non-deformable $Al_2O_3$ inclusions are transformed into plastic calcium aluminate inclusions with a low melting point and are transformed into liquid $12CaO \cdot 7Al_2O_3$ at a steelmaking temperature, and most of the liquid calcium aluminate inclusions float out of the molten steel and are adsorbed and removed by the slag.

In a preferred embodiment of the present disclosure, in step b, refining is performed outside the LF to form a high-content MgO and $Al_2O_3$ slag system to further remove oxygen out of the steel, then, relatively weak argon is introduced, stirring is performed to remove small-size inclusions by bubbles, and the small-size inclusions collide with each other and aggregate to form large-size inclusions, so that the inclusions float up quickly and are removed.

In a preferred embodiment of the present disclosure, in step b, an inner wall of an ingot mold is cleaned to keep smooth and clean, and various tiny impurities in the mold are absorbed and removed; a pouring system is made of a high-quality refractory material and needs to be cleaned; the pouring system is filled with argon in advance for protection; when the molten steel enters the mold, the protective slag ladle is heated and spread, and the volume of the molten steel is controlled to rise steadily; and during cooling and solidification of the molten steel, the feeding of a riser is sufficient to eliminate defects such as shrinkage cavities generated during pouring and cooling.

In a preferred embodiment of the present disclosure, in step d, during high temperature forging, a forging temperature is controlled at 1110-1150° C., and an overall forging compression ratio is 3-5; after being forged, a steel ingot is returned to the furnace and further heated to reach 1130±20° C., and the temperatures of the inside and outside of the forged piece along a transverse cross section are kept consistent, so as to avoid various defects caused in a situation where the outside reaches the temperature but the inside does not reach the deformation temperature; and the heated billet is rolled into a pipe billet with a diameter of 65 mm or 82 mm in a bar mill, an outer diameter tolerance is controlled at ±0.1 mm, and an ovality is less than or equal to 0.12 mm.

In a preferred embodiment of the present disclosure, in step e, during a low temperature heating stage of the sloping hearth heating furnace, by appropriately prolonging the heating time to increase the frequency of steel turnover of a round steel pipe billet, the temperature distribution along the cross section and length direction of the pipe billet is more uniform; during a high temperature heating stage, by quickly heating to a required temperature and then performing heat preservation sufficiently in a soaking section, the temperature difference of the pipe billet along the cross section and the length direction is reduced, so as to ensure that the temperature field of the whole pipe billet is uniformly distributed; for a pipe billet with a diameter of 65 mm, a heating temperature is 1150-1190° C., a heating time is controlled at 150-160 min, a holding time is controlled at 15-30 min, and a rotation rate of the piercer is controlled at 85-89 rpm; and for a pipe billet with a diameter of 82 mm, a heating temperature is 1160-1200° C., a heating time is controlled at 180-290 min, a holding time is controlled at 25-50 min, and a rotation rate of the piercer is controlled at 73-77 rpm.

In a preferred embodiment of the present disclosure, in step e, the solution heat treatment temperature is controlled at 1100-1120±10° C., a heating rate of the furnace is controlled at 2-2.5° C./s, and after reaching the solution heat treatment temperature, the holding time is controlled at 10-25 min.

In a preferred embodiment of the present disclosure, in step e, before the solution heat treatment, in order to ensure the quality of pickling and degreasing, the corresponding acid ratio concentration and pickling time are set according to different pickling conditions, and the circulation volume of acid liquor is increased to 150 L/min during pickling; then, a multi-piece rotary cleaning apparatus is used and a special rolling brush is fed while rolling at a rotation rate of 160-400 rpm with a back-and-forth feed of 3-10 mm/S; a surface is brushed back and forth by rolling with kerosene as, a medium to remove oil dirt; finally, an endoscope is used for inspecting, the position of a defect sticking to an inner surface of the pipe is marked, and the pipe is then polished by an inner hole polishing device with a 150-mesh grinding wheel to remove the defect and then re-polished with 500-mesh sandpaper; and the solution heat treatment process can be performed after the pipe passes the re-inspection by the endoscope.

In a preferred embodiment of the present disclosure, in step f, intermediate products are respectively rolled into products with specifications of Φ38 mm*3.5 mm and Φ45 mm*5 mm by cold rolling, the cold rolling feed is 3.0 mm/n, and rates of mills are 65 times/min and 45 times/min respectively; in a final pass, pipes are rolled into finished products with specifications of Φ25 mm*2.7-2.8 mm, Φ26.7 mm*2.87 mm, Φ33.4 mm*4.55 mm and Φ60.3 mm*8.74 mm, the cold rolling feed is 2.0 mm/n, and rates of two mills are 100 times/min and 75 times/min respectively; and the pipe with a specification of Φ25 mm*2.7-2.8 mm is drawn into a product with a specification of Φ21.3 mm*2.77 mm.

Beneficial effects of the present disclosure: A high-property super austenitic ferrite duplex stainless steel seamless pipe manufactured by the S32750 austenitic ferrite super duplex stainless steel seamless pipe for a deep sea manifold and the method for preparing the same in the present disclosure has the characteristics that the ferrite content is controlled at 40-60%, and the PREN is controlled at 41-45; mechanical properties at a room temperature are as follows: the tensile strength is greater than or equal to 800 Mpa, the yield strength is greater than or equal to 550 Mpa, the elongation after fracture is greater than or equal to 25%, the impact energy at a low temperature of −46° C. is greater than or equal to 60 J, the yield ratio is not higher than 0.9, and the HRC is less than or equal to 28; and according to an ASTM G48 A method, in the case of 50° C.*24 h, there is no obvious pitting corrosion and the weight loss is less than 4.0 $g/m^2$ under the magnification of 20 times, and there is no harmful intermetallic phase and precipitated phase under the magnification of 400-500 times.

By means of optimization of metal components, according to the design of mechanical properties and pitting corrosion property requirements of super duplex stainless steel for a deep sea underwater manifold, the metal components of the duplex steel are optimized. The content of the N element in the steel is 0.26-0.32%, the balanced design of the two-phase ratio and the PREN is realized, the structure properties of the duplex steel are optimized, accurate control of the content of the N element can balance the two-phase ratio and the PREN, and at the same time, a formation rate and a precipitation volume of a σ phase gradually decrease until disappear.

Through Al powder enhanced deoxidization, slag system optimization, calcium treatment and weak stirring technology, the Al content in the steel is controlled at 0.012-0.018%, so as to ensure that the oxygen content is reduced to 11-25 ppm, achieve ultra-low oxygen and inclusion miniaturization of the S32750 steel, realize dispersion refining, significantly improve the purity of the steel, and improve the mechanical properties, fracture toughness and fatigue strength.

Based on a thermal simulation test and the study of the dynamic structure evolution rule, the plug deflection is appropriately reduced, and a contrast test of each plug deflection is performed respectively to determine suitable parameters. Furthermore, a roller rate is optimized to determine an optimal piercing rate. Taking rolled pipe deformation and structure property requirements as constraint conditions, combined with the rolled hardening effect, the hardening gradient distribution and the pass transfer action, a cold rolling forming deformation and a distribution process are formed, and the processing deformation of each pass is reasonably distributed.

BRIEF DESCRIPTION OF THE SEVERAL VIEWS OF THE DRAWINGS

In order to make the technical solutions of embodiments of the present disclosure more clear, drawings to be used for description of embodiments will be explained briefly as follows. Obviously, drawings used in the following description are merely some embodiments of the present disclosure. Those skilled in the art also may obtain other drawings based on these drawings without paying creative labor, among which

Numerical references of components in the figures.

DETAILED DESCRIPTION OF THE INVENTION

Figure 1:
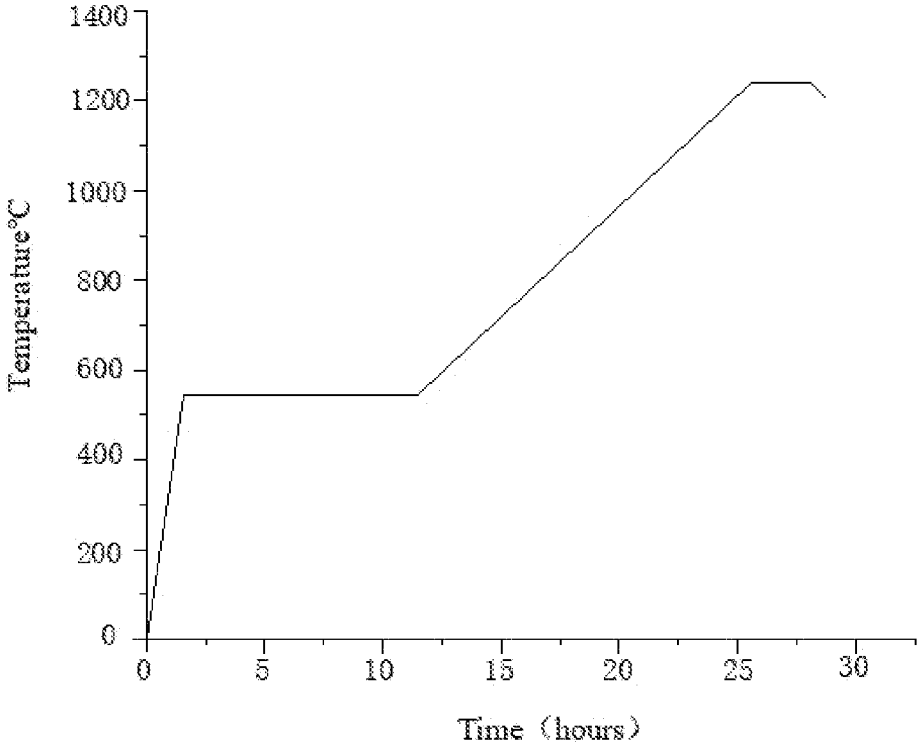
FIG. 1 is a schematic diagram of a heating-up process curve of an S32750 austenitic ferrite super duplex stainless steel seamless pipe for a deep sea manifold in the present disclosure.

The technical solutions in the embodiments of the present disclosure will be described clearly and completely below, and it will be apparent that the embodiments described herein are merely a part, not all of the embodiments of the present disclosure. All other embodiments obtained by a person of ordinary skill in the art based on the embodiments of the present disclosure without creative efforts shall fall within the scope of the present disclosure.

Optimization of metal components and collaborative design of two-phase ratio and PREN of steel:

In view of the contradiction among inherent key joint control elements such as high yield strength, two-phase ratio control, low temperature toughness and pitting corrosion resistance of the S32750 super austenitic duplex stainless steel, firstly, based on the accurate design of key elements, the relationship between strength and toughness and corrosion resistance and alloy components is established, and secondly, the relationship between phase size refinement, high purity of deoxidization and dehydrogenation and high-property preparation of rolling and heat treatment is clarified. A thermodynamic calculation model is used for calculating the relationship between different components on comprehensive properties, and establishing the relationship between alloy components and strength and toughness, yield ratio and pitting corrosion resistance rate, thereby providing a theoretical basis for the design of comprehensive properties of key alloy elements.

The S32750 super austenitic ferrite duplex stainless steel seamless pipe for a deep sea manifold includes the following components in percentage in mass: less than or equal to 0.03% of C, less than or equal to 0.80% of Si, less than or equal to 1.20% of Mn, less than or equal to 0.035% of P, less than or equal to 0.01% of S, 24.0-26.0% of Cr, 6.0-8.0% of Ni, 3.0-5.0% of Mo, less than or equal to 0.50% of Cu, 0.24-0.32% of N, 0.012-0.018% of Al, and the balance of Fe and impurities.

Through a large number of experiments and studies, in order to ensure that the ferrite content of the S32750 super duplex stainless steel is controlled at 40-60%, wherein in the steel, Cr, Mo and Si are main elements for forming a ferrite phase α, and Ni, N, Cu and Mn are main elements for forming an austenite phase γ, the two-phase ratio is adjusted by adjusting the contents of ferrite and austenite elements. The equivalent formula of the ferrite forming element Cr is Creq equivalent=Cr %+1.5*Mo %+1.5*Si %. The equivalent formula of the austenite forming element Ni is Nieq equivalent=Ni %+0.5*Mn %+30*(C+N) %+0.3*Cu %. By analyzing the influence of the change of Cr, Mo, Ni and N elements on the S32750 ferrite, N is a key factor for adjusting the ferrite content.

Through a large number of experiments and studies, the PREN is controlled at 41<PREN<45. Furthermore, Cr, Mo and N are key elements affecting the pitting corrosion resistance of the super S32750 steel, and PREN=Cr %+3.3*Mo %+16*N % is used for evaluating the macro pitting corrosion resistance of the duplex stainless steel. Based on different trends of the contents of Cr, Mo, N and Ni affecting PRENα and PRENγ, when the contents of Cr, Mo and Ni elements in the duplex steel are constant, N plays a key role in adjusting the two-phase PREN difference (to achieve PRENα=PRENγ). The change of Cr, Mo and N elements in the steel can adjust the PREN, wherein the change of the content of the N element can significantly adjust the two-phase ratio and the PREN phase. Therefore, N can improve corrosion resistance and strength properties, and can significantly and accurately control the two-phase ratio and the PREN. Considering that the content of the gas element N is difficult to control during smelting, the content of the N element in the steel is 0.26-0.32%, so as to achieve the balanced design of the two-phase ratio and corrosion resistance of the S32750 steel.

The S32750 super austenitic ferrite duplex stainless steel needs to meet low temperature impact toughness (−46° C.

Akv≥60 J) and meet the requirement that according to an ASTM G48 A method, in the case of 50° C.*24 h, there is no obvious pitting corrosion and the weight loss is less than 4.0 g/m$^2$ under the magnification of 20 times. The ferrite forming elements such as Cr, Mo and Si in the S32750 steel can promote the precipitation of the σ phase, and the increase in the contents of the austenite forming elements such as C, N and Ni will reduce the volume fraction of the ferrite forming elements, so that the precipitation volume of the σ phase decreases, the σ phase will lead to depletion of Cr and Mo around a matrix, and the pitting corrosion resistance of the S32750 steel is significantly reduced. As a result, during the design of the components of the S32750 steel, higher-content Cr, Mo, Ni and N can significantly improve the corrosion resistance and strength, accurate control of the content of the N element can balance the two-phase ratio and the PREN, and at the same time, the formation rate and the precipitation volume of the σ phase gradually decrease until disappear.

Smelting technology of high-purity austenitic ferrite duplex stainless steel: the smelting technology of the austenitic ferrite duplex stainless steel uses an EAF, an AOD converter and an LF for smelting, primary smelting is performed in the EAF to remove impurities such as P, S and O in the steel, and the temperature of molten steel is adjusted to obtain specified components.

Through a large number of experiments and studies, Si deoxidization and Al deoxidization are respectively used and compared in smelting in the AOD furnace, and a deoxidization process of Al particles and slag powder mixed with aluminum powder, which has a good deoxidization effect, is selected. By adding 3 or 5 mm deoxidization aluminum shots (with an Al content of greater than or equal to 99.7%), the deoxidization amount of the steel is ensured. After Al deoxidization, the deoxidized product exists in the molten steel in the form of $Al_2O_3$ inclusions, thereby greatly increasing the number of the $Al_2O_3$ inclusions in the molten steel. The refining slag needs to be optimized, high-Al alkaline refining slag includes the following components: 55-70% of CaO, 10-20% of $SiO_2$, and 15-20% of $Al_2O_3$, and floating inclusions are adsorbed to reduce the content of the $Al_2O_3$ inclusions in the steel. Further, calcium is added to the molten steel to change the morphology of $Al_2O_3$ in the molten steel, hard and non-deformable $Al_2O_3$ inclusions are transformed into plastic calcium aluminate inclusions with a low melting point and are transformed into liquid $12CaO \cdot 7Al_2O_3$ at a steelmaking temperature. Most of the liquid calcium aluminate inclusions float out of the molten steel and are adsorbed and removed by the slag.

A high-content MgO and $Al_2O_3$ slag system is formed in refining outside the LF to further remove oxygen out of the steel, then, relatively weak argon is introduced, and stirring is performed, so that on the one hand, small-size inclusions are removed by bubbles, and on the other hand, the small-size inclusions collide with each other and aggregate to quickly form large-size inclusions, and the inclusions float up quickly and are removed. Through Al powder enhanced deoxidization, slag system optimization, calcium treatment and weak stirring technology, the Al content in the steel is controlled at 0.012-0.018%, so as to ensure that the oxygen content is reduced to 11-25 ppm, achieve ultra-low oxygen and inclusion miniaturization of the S32750 steel, realize dispersion refining, significantly improve the purity of the steel, and improve the mechanical properties, fracture toughness and fatigue strength.

Pouring: a liquidus temperature of molten steel of S32750 stainless steel is calculated, and an overheating degree of pouring is reasonably controlled; and a solidification process is controlled by controlling a temperature field so as to effectively control macro segregation and interdendritic segregation.

In order to avoid secondary pollution caused by the pouring process, an inner wall of an ingot mold is cleaned to keep the inner wall smooth and clean, and various tiny impurities in the mold are absorbed and removed; a pouring system is made of a high-quality refractory material and needs to be cleaned; the pouring system is filled with argon in advance for protection; when the molten steel enters the mold, the protective slag ladle is heated and spread, the obstruction of the molten steel can be effectively avoided, and the volume of the molten steel is controlled to rise steadily; and during cooling and solidification of the molten steel, the feeding of a riser is sufficient to eliminate defects such as shrinkage cavities generated during pouring and cooling.

Forging: under the guidance of physical metallurgy principles and analog simulation, natural gas heating and forging technologies are used for eliminating forging σ phase precipitation and phase size refinement by coupling control of a full-size temperature field and a strain field of a forged piece, so as to obtain a structure with a coordinated two-phase ratio, a yield ratio not higher than 0.9 and an HRC less than or equal to 28.

Due to a narrow hot processing temperature range of the S32750 super austenitic ferrite duplex stainless steel, during high temperature forging, the softer ferrite is softened before the austenite, which is easy to cause the increase of the ferrite content and the increase of the phase size, and thus, the two-phase ratio and the PREN are unbalanced. As a result, the forging temperature is strictly controlled, and especially, the actual forging temperature of the last large deformation is controlled at 1110-1150° C. In order to obtain a duplex stainless steel pipe billet with no precipitation and a fine structure, an overall forging compression ratio is 3-5. After being forged, a steel ingot is returned to the furnace and further heated to reach 1130±20° C., and the temperatures of the inside and outside of the forged piece along a transverse cross section are kept consistent, so as to avoid various defects caused in a situation where the outside reaches the temperature but the inside does not reach the deformation temperature. The heated billet is rolled into a steel bar with a diameter of 65 mm or 82 mm in a bar mill, an outer diameter tolerance is controlled at ±0.1 mm, and an ovality is less than or equal to 0.12 mm.

Hot piercing: stainless steel hot piercing is a transformation process of a solid pipe billet to a hollow pierced billet under the synergy of multiple factors. Through a large number of experiments and studies, during deformation at 1160-1200° C., due to the high contents of alloy components in the S32750 steel, two-phase structure characteristics at a high temperature, harmful phase precipitation, etc., a relatively narrow steady-state deformation region for the interaction between deformation hardening and dynamic softening is formed, the flow stress in the steady-state region directly affects the thermoplasticity of the steel, and the opposite thermoplastic region is narrow. During hot piercing, there are longitudinal stretching and circumferential compression of a roller and a pipe, and multi-directional complex deformation of the plug and the pipe. The control difficulty of the hot piercing process is very high. For hot piercing of the super duplex stainless steel, if the deformation temperature and deformation process parameters are not properly controlled, it is very easy to cause crack nucleation and propagation at a phase boundary. Therefore, higher requirements are put forward for a hot piercing preparation process of the pipe billet of the S32750 super duplex stainless steel.

Through a large number of experiments and studies, a mathematical model based on the temperature-stress strain multi-field coupling during hot piercing is proposed. During hot piercing, the interaction of multiple physical fields occurs inside a round pipe billet during the transfer from solid to hollow, which accurately simulates the behavior of improving process characteristics under multi-coupling conditions during hot piercing, thereby laying a foundation for the development of the hot piercing process.

Through a large number of experiments and studies, the control of hot piercing process parameters of the S32750 super duplex stainless steel is very important for the formation of hot piercing of the duplex stainless steel. Moreover, the design and control of process parameters will also affect the temperature distribution of each part of the pierced billet during actual piercing. A deformation rate has a great influence on the temperature inside the cross section of the pierced billet, and improper control can easily cause uneven temperature, uneven structure distribution and harmful phase precipitation of the pierced billet, and cause local stress concentration and reduction in thermoplasticity, which becomes the main problems restricting hot piercing production. Based on the hot piercing characteristics of different calibers of super duplex stainless steel, in actual control of the hot piercing process of the S32750 super duplex stainless steel, by optimizing the process parameters such as the heating-up curvature and time of each section during furnace heating, and combining the change distribution characteristics of the stress-strain field and temperature field of cross piercing with a large grinding angle and the temperature field during plug piercing, high-quality hot piercing of hot piercing formation and cooperative control of the structure and properties is realized. By reasonably selecting piercing process parameters, such as billet heating temperature, holding time, guide plate spacing, roller spacing and roller rate, the uneven deformation and additional tensile stress generated in the piercing deformation region are reduced as much as possible, thereby achieving high production efficiency and high yield.

A piercing heating system is optimized. During a low temperature heating stage of a sloping hearth heating furnace, by appropriately prolonging the heating-up time to increase the frequency of steel turnover of a round steel pipe billet, the temperature distribution along the cross section and length direction of the pipe billet is more uniform; and during a high temperature heating stage, by quickly heating to a required temperature and then performing heat preservation sufficiently in a soaking section, the temperature difference of the pipe billet along the cross section and the length direction is reduced, so as to ensure that the temperature field of the whole pipe billet is uniformly distributed. For a pipe billet with a specification of Φ65 mm, a heating temperature is 1150-1190° C., a heating time is controlled at 150-160 min, and a holding time is controlled at 15-30 min. For a pipe billet with a specification of Φ82 mm, a heating temperature is 1160-1200° C., a heating time is controlled at 180-290 min, and a holding time is controlled at 25-50 min, as shown in FIG. 1.

Based on a thermal simulation test and the study of the dynamic structure evolution rule, the plug deflection is appropriately reduced, and a contrast test of each plug deflection is performed respectively to determine suitable parameters. Furthermore, a roller rate is optimized to determine an optimal piercing rate, thereby solving the problem that the internal temperature increases due to the severe friction between the round steel and a plug interface during hot piercing. A piercing deformation rate can not be too fast. For a pipe billet with a specification of Φ65 mm, the piercing deformation rate is controlled at 85-89 rpm, and for a pipe billet with a specification of Φ82 mm, the piercing deformation rate is controlled at 73-77 rpm, thereby avoiding defects caused by uneven temperatures of inner and outer pipe walls.

Cold working: through a large number of experiments and studies, aiming at the characteristic of a high yield ratio of the super duplex stainless steel, the matching between the allowable deformation and the rolling forming pass is established, and a key process of integrated cold deformation control of hot piercing, high temperature intermediate solution heat treatment, deformation and distribution is formed. Softening is performed at a higher intermediate solution heat treatment temperature to prepare for subsequent processing of finished cold rolled pipes. With reference to higher yield strength, larger initial deformation resistance of cold deformation and incompatibility of two-phase deformation of the S32750 stainless steel, rolling cracks are easy to occur. Therefore, taking rolled pipe deformation and structure property requirements as constraint conditions, combined with the rolled hardening effect, the hardening gradient distribution and the pass transfer action, a cold rolling forming deformation and a distribution process are formed, and the processing deformation of each pass is reasonably distributed.

In order to meet pipe structure and property requirements, on the basis of mastering the phase size coarsening rule and cold working hardening and softening rules of the super duplex stainless steel S32750, the cold rolling deformation distribution and property control rules are mastered, so as to meet the conditions of no harmful phase precipitation, high impact toughness of two-phase equilibrium and high pitting corrosion resistance of finished pipes of the super duplex stainless steel. According to the requirements of different specifications and group spacing, the matching between the corresponding processing volume and the process pass is formed, and a relationship function of hot piercing, intermediate cold rolling and final pass cold rolling and a corresponding matching model are formed.

Due to the characteristics of high yield strength and difficult cold deformation of the super duplex stainless steel seamless pipe, during pipe rolling, it is easy to cause an asynchronous sliding phenomenon between the tool and mould and the surface of a metal pipe, which causes friction scratches on inner and outer surfaces. The flow of lubricating oil is increased by means of circumferential spraying forced lubrication and can be adjusted to 1.5-3 L/s according to rolling conditions, and the nozzle pressure is increased to 5 Mpa. The rolling oil with higher viscosity is preferred.

Based on the characteristic of high Cr, Mo and N contents of the super S32750 duplex stainless steel seamless pipe, the surface roughness of the pipe is easily increased after processing of the cold rolled pipe. The pierced billet is ground with a coarse grinding wheel to remove spiral segments on the surface and then is finely polished to remove burrs and broken particles produced by coarse grinding. After fine polishing, the surface roughness of the pipe is increased to Ra≤6.3, which ensures the surface quality of an intermediate rolled pipe. Before a finished pipe is rolled, a dual-purpose polishing machine for inner and outer walls is used for grinding and then polishing an intermediate pipe before the finished product is rolled, thereby ensuring the surface quality of the finished pipe.

The whole cold working process uses a short-stage production process mainly by cold rolling supplemented with cold drawing, which conforms to the characteristics of multiple procedures and multi-pass cycles in stainless steel pipe production, that is, meets the process requirements of small lot, multiple batches and multiple specifications, and has good cost efficiency.

For a straightening method of the super duplex stainless steel seamless pipe, an eleven-roller straightening machine is used for straightening, so as to increase the straightness of the pipe. The eleven-roller straightening machine is formed by staggered arrangement of opposite pass rollers. By adjusting the offsets of upper and lower rollers to be 3.5-5% of the outer diameter of an inlet pipe of the straightening machine, when the first pipe is straightened, the pipe is adjusted according to the actual straightness after straightening.

Through a large number of experiments and studies, intermediate annealing is performed at a temperature which can not only used for softening by intermediate solution heat treatment but also ensure no precipitated phase and no significant increase of phase size, thereby laying a foundation for obtaining a larger deformation, preventing the excessive growth of the structure from adversely affecting the structure and property control of a solid solution pipe, and realizing continuous refinement of the phase size during cold deformation and intermediate annealing. The solution heat treatment temperature of the final pass is relatively low to meet comprehensive property requirements.

By optimizing the change of the intermediate solution heat treatment temperature of the S32750 super duplex steel on the structure value, the formation rule of the phase size growing with the change of the intermediate annealing temperature is mastered. The initial temperature at which the sizes of two phases of the S32750 steel significantly increase is 1150° C. On this basis, the corresponding values of the structure, softening value and heat treatment temperature are detected to further optimize the intermediate solution heat treatment temperature of the S32750 super duplex steel.

Through a large number of experiments and studies, when the solution heat treatment temperature of the S32750 stainless steel pipe is in a heating-up range of 900-1000° C., a harmful secondary phase is easily caused. The most harmful σ phase precipitation position is basically at a boundary between an austenite phase γ2 and a ferrite phase α near an original grain boundary of ferrite (eutectoid reaction α→σ+γ2). The a phase nucleates preferentially at α/α and α/γ grain boundaries, and grows into ferrite in a block or sheet form, resulting in a sharp decline in plastic toughness and an increase in hardness of the pipe. The precipitation and dissolution of the σ phase are closely related to the solution heat treatment temperature. At 1100-1300° C., the hardness increases with the increase of the annealing temperature, which is mainly because with the increase of the annealing temperature, the content of the ferrite phase in the structure of the S32750 steel increases continuously.

Relationship between solution heat treatment temperature and phase composition and phase ratio of S32750 steel: After testing and optimization, at 1020° C., the σ phase begins to precipitate and increases quickly with the temperature drop; and at 1040° C., the two-phase structure is uniform after solution treatment, and there is no precipitated phase. When the temperature is higher than 1040° C., the amount of austenite phases is reduced, and the ratio of ferrite phases is increased. At 1040-1100° C., the two-phase ratio of the S32750 steel changes little. In order to maintain good mechanical properties and corrosion resistance, the control of the two-phase ratio needs to be optimal in a solution temperature range of 1040-1100° C.

Change of solution heat treatment temperature and tensile value of S32750 steel: After testing and optimization, with the increase of the solution temperature, the tensile strength and yield strength first decrease and then increase, but after the solution treatment at a temperature greater than 1020° C., the tensile strength changes gently. The expansion, elongation and impact toughness change opposite to the strength, namely first increase and then decrease. Through a large number of experiments and studies, when the heating temperature is lower than 1040° C., the σ phase is easy to precipitate in the S32750 steel, so that the steel is prone to brittle cracking. The solution heat treatment process needs to avoid this temperature range and quickly cool to pass through a σ phase precipitation region. After optimization, when the solution heat treatment temperature is 1040-1100° C., the mechanical properties of the S32750 steel are excellent and stable. In order to ensure that the S32750 steel has good mechanical properties at a room temperature, the solution heat treatment of the finished product needs to be performed in a temperature range of 1040-1100° C.

Change of solution heat treatment temperature and pitting corrosion resistance value of S32750 steel: After testing and optimization, at 900-1300° C., with the increase of the solution heat treatment temperature, the corrosion rate first decreases and then increases, so that the solution heat treatment temperature range is the key to optimize the pitting corrosion resistance value. If the solution heat treatment temperature is lower than 1000° C., the precipitation of the chromium-rich σ phase reduces the content of the chromium element in the matrix, and thus, the corrosion resistance decreases. If the solution heat treatment temperature is higher than 1100° C., the excessively high ferrite phase content reduces the contents of Cr and Mo elements in the phase, resulting in the imbalance of the PREN of the two phases, and the preferential corrosion of the weak phase causes the decrease of the overall corrosion resistance of the S32750 super duplex stainless steel seamless pipe. Through optimization, the solution heat treatment at 1050-1100° C. can minimize the pitting corrosion rate.

Change of solution heat treatment temperature and impact toughness value of S32750 steel at low temperature of −46° C.: After testing and optimization, the solution heat treatment temperature of the S32750 steel is 1080° C. when the ratio of the ferrite phase to the austenite phase is 1:1, and there is no harmful phase precipitation. In this range, the influence of the phase ratio change on the low temperature impact toughness of the steel is significantly higher than the influence on the room temperature impact toughness. The main reason is that with the increase of the content of the austenite phase, the austenite/ferrite phase boundary and the ferrite phase decrease, so as to reduce the probability of crack initiation during impact. Furthermore, the austenite phase with a reticular or approximate reticular structure plays a good role in preventing impact cracks, thereby improving the impact toughness of the steel. The reasonable ferrite content is realized, and the low temperature impact toughness of the finished duplex stainless steel pipe is improved.

Through a large number of experiments and studies, in order to ensure the phase ratio, strength and toughness and pitting corrosion property requirements of the steel pipe, the relationship between the phase ratio and the mechanical properties, pitting corrosion property and low temperature impact toughness of the S32750 steel is revealed, and a reasonable solution heat treatment system with uniform temperature and quick cooling is formulated. Since the temperature of a furnace chamber is measured from a temperature rise point of the furnace to the inside of a soaking point, in order to avoid the σ phase precipitation of the S32750 pipe during heating-up, it is not allowed to stay too long at 320-955° C. which is sensitive to the σ phase precipitation, resulting in poor toughness and corrosion resistance of the pipe, and the heating rate is controlled at 2-2.5° C./s. The heating temperatures for the solution heat treatment of the intermediate pipe and the solution heat treatment of the finished pipe need to be within the temperature range of complete dissolution of the σ phase. The solution heat treatment of the intermediate pipe needs to be performed in a temperature range where there is no precipitated phase and the phase size does not grow significantly, so as to create conditions for the subsequent processing and deformation of the cold rolled pipe, and the solution heat treatment temperature is appropriately higher and is controlled at 1120±10° C. The solution heat treatment of the finished pipe needs to be performed at a place where the ratio of the two phases is similar, so as to meet the strength and toughness and pitting corrosion property requirements, and the temperature is appropriately lower and is controlled at 1100±10° C. The holding time is controlled at 10-25 min.

A continuous roller hearth type solution heat treatment furnace for tunnel type solution heat treatment is used. A feeding section preheats the stainless steel pipe from a feed port to a combustion section (the stainless steel pipe is preheated to a temperature greater than or equal to 300° C.), thereby reducing the consumption of natural gas. A heating-up section uses a regenerative flat flame burner and a controller. By adjusting the opening and closing frequency of the burner to adjust the supply of the natural gas, a high-power combustion state is achieved, an air-fuel ratio is accurately controlled, the gas circulation and stirring in the furnace are strengthened, and the temperature rises quickly across the σ phase precipitation region (≥1000° C.). A soaking section maintains the best solution temperature and improves the temperature uniformity. A touch integrated industrial computer and a programmable logic controller (PLC) are used for realizing intelligent control of parameter setting, furnace combustion atmosphere, etc., so as to meet the requirements of the solution heat treatment process of the super duplex stainless steel pipe. A cooling section uses a five-stage upper and lower hedging spray curtain large-flow cooling apparatus and a matched cooling and filtering circulating water system, the quick cooling rate can be adjusted to 35-90° C./s, and the pipe can be quickly cooled to a room temperature.

According to the principle of the corrosion resistance rate of super duplex stainless steel oxides, through a large number of experiments and studies on the influence of the component, concentration, temperature and pickling time of a pickling solution on the passivation effect of the surface of different steel grades, the surface has stronger corrosion resistance.

The super duplex stainless steel seamless pipe has high corrosion resistance. In order to ensure the quality of pickling and degreasing of the super duplex stainless steel seamless pipe, the corresponding acid ratio concentration and pickling time are set according to different pickling conditions (pickling, degreasing, and passivation). Due to the characteristics of a large aspect ratio of the pipe and the difficult pickling of an inner hole, the circulation volume of acid liquor is increased to 150 L/min during pickling.

In a case that for a small inner hole, after the grease scale which sticks to the surface of the inner hole by large-deformation cold rolling is pickled, the grease scale still sticks to the inner surface of the pipe and cannot be removed by washing, a special multi-piece rotary cleaning apparatus is used, and a special rolling brush is fed while rolling at a rotation rate of 160-400 rpm with a back-and-forth feed of 3-10 mm/S. The surface is brushed back and forth by rolling with kerosene as a medium to remove oil dirt.

An endoscope is used for inspecting, the positions of defects, such as the grease scale sticking to the inner surface of the pipe, hairline cracks and micro pits, are marked, and the pipe is first polished by a special inner hole polishing device with a 150-mesh grinding wheel to remove the defects, and then, re-polished with 500-mesh sandpaper. The next process can be performed after the pipe passes the re-inspection by the endoscope.

Embodiment 1: The molten steel of the composition is smelted by an electric furnace and external refining, and cast and forged into a steel billet (a raw material of a steel pipe) by die casting, as shown in Table 1.

TABLE 1

Test results of chemical components of S32750 super duplex stainless steel Wt/%

| Steel pipe | Chemical composition (unit mass %, the rest are Fe and impurities) | | | | | | | | | | |
|---|---|---|---|---|---|---|---|---|---|---|---|
| Number | C | Mn | P | S | Si | Cr | Ni | Mo | N | Cu | O |
| Finished | 0.020 | 0.727 | 0.026 | 0.002 | 0.522 | 25.680 | 6.507 | 3.924 | 0.269 | 0.150 | 15 ppm |
| product | 0.021 | 0.747 | 0.025 | 0.001 | 0.529 | 25.683 | 6.672 | 3.991 | 0.268 | 0.156 | 14 ppm |

Based on the actually measured values of the contents of Cr, Mo and N elements in Table 1, the PREN is calculated to be 42.99 respectively according to the formula PREN=C % r+3.3*Mo %+16*N %.

The ferrite content is determined by point counting according to standards of ASTM E562. Ten representative fields of view are randomly selected, and the ferrite content is detected to be 46.3% by means of point counting.

A super duplex stainless steel round pipe billet is heated to a temperature greater than or equal to 1160° C. by a sloping hearth heating furnace. After heat preservation and soaking, each round steel bar is pierced and rolled by a cross piercer with a large grinding angle to obtain pierced billets with specifications of Φ65 mm*5.0 mm, Φ82 mm*8.0 mm and Φ82 mm*12.0 mm.

S32750 stainless steel billets of different specifications are used as raw materials, pierced billets are prepared by hot piercing, and the pierced billets are completely inspected visually and ground to remove various defects on inner and outer surfaces. After finishing, the requirements for outer diameters and wall thickness sizes of the pierced billets are shown in Table 2.

| S32750 | | | | | |
|---|---|---|---|---|---|
| | Requirements for size, tolerance and straightness of pierced billet (mm) | | | | |
| Outer | Outer diameter | Wall | Wall thickness | Single side | Straightness |
| Φ65 mm | ±2.0 mm | 5.0 mm | ±1.5 mm | ≤1.0 mm | ≤1.5 mm |
| Φ65 mm | ±2.0 mm | 5.0 mm | ±1.5 mm | ≤1.0 mm | ≤1.5 mm |
| Φ82 mm | ±2.5 mm | 8.0 mm | ±2.0 mm | ≤1.5 mm | ≤2.0 mm |
| Φ82 mm | ±2.5 mm | 12.0 mm | ±2.0 mm | ≤1.5 mm | ≤2.0 mm |

A steel pipe is manufactured mainly by cold rolling supplemented with cold drawing in cold working by using a cold rolling mill for controlling deformation, solution heat treatment is implemented, and a temperature and a time are controlled to manufacture a steel pipe with the same grain size as a finished product. An implementation scheme of a cold working process is shown in Table 3.

| Cold rolling specification (mm) | Outer diameter range (mm) | Wall thickness range (mm) | Surface roughness (um) |
|---|---|---|---|
| Φ21.3*2.77 | 20.50-21.70 | 2.42-2.77 | 0.8 |
| Φ26.7*2.87 | 25.90-27.10 | 2.51-2.87 | 0.8 |
| Φ33.4*4.55 | 32.60-33.80 | 3.98-4.55 | 0.8 |
| Φ60.3*8.74 | 59.50-61.10 | 7.65-8.74 | 0.8 |

The heat treatment process uses a natural gas roller hearth type solution heat treatment furnace. A preheating section is set: the heating-up length is 5.5 m, and the set temperature is 300° C.; a heating-up section is set: the heating-up length is 11 m, and the set temperature is 1100° C.; a soaking section is set: the heating length is 5.5 m, the set temperature of an intermediate product is 1120° C., and the set temperature of a finished product is 1100° C.; and a cooling section is set: the cooling section is a five-stage upper and lower spray curtain cooling water apparatus, the feed is controlled by a variable-frequency speed control system and is correspondingly adjusted according to different specifications, and the feeding rate is 0.6-2.0 m/min. σ phase precipitation is avoided by quick cooling.

| Implementation scheme of cold working (mm, ° C., min) | | | | | | | | | | | |
|---|---|---|---|---|---|---|---|---|---|---|---|
| Test NO | Supply specifications | | First rolled pipe specifications | | Solution heat treatment conditions | | Finished rolling specifications | | Solution heat treatment conditions | | Elongation coefficient |
| 1 | Outer | 65 | Outer | 38 | Temperature | 1120 ± 10° C. | Outer | 25 | Temperature | 1100 ± 10° C. | 5.84 |
| | Wall | 5.0 | Wall | 3.5 | Time | 22 ± 3 min | Wall | 2.8 | Time | 19 ± 1 min | |
| 2 | Outer | 65 | Outer | 38 | Temperature | 1120 ± 10° C. | Outer | 26.7 | Temperature | 1100 ± 10° C. | 4.39 |
| | Wall | 5.0 | Wall | 3.5 | Time | 22 ± 3 min | Wall | 2.87 | Time | 20 ± 2 min | |
| 3 | Outer | 82 | Outer | 45 | Temperature | 1120 ± 10° C. | Outer | 33.4 | Temperature | 1100 ± 10° C. | 4.51 |
| | Wall | 8.0 | Wall | 5.0 | Time | 43 ± 3 min | Wall | 4.55 | Time | 37 ± 2 min | |
| 4 | Outer | 82 | Outer | 60.3 | Temperature | 1100 ± 10° C. | Outer | | Temperature | | 1.86 |
| | Wall | 12.0 | Wall | 8.74 | Time | 76 ± 3 min | Wall | | Time | | |

Note:
A specification of 21.3 mm*2.77 mm is a special specification. The billet is rolled into a product with a specification of 25 mm*2.7-2.8 mm so as to be drawn into a finished product.

Pierced billets with two specifications of Φ65 mm and Φ82 mm are respectively rolled into products with specifications of Φ38 mm*3.5 mm and Φ45 mm*5 mm on LG60-H and LG120-H cold rolling mills, the cold rolling feed is 3.0 mm/n, and rates of the mills are 100 times/min, 65 times/min and 45 times/min respectively. in a final pass, the pipes are directly rolled into finished products with specifications of Φ25 mm*2.7-2.8 mm, Φ26.7 mm*2.87 mm, Φ33.4 mm*4.55 mm and Φ60.3 mm*8.74 mm respectively on LG30-H, LG60-H and LG120-H cold rolling mills, the cold rolling feed is 2.0 mm/n, and rates of the mills are 100 times/min, 75 times/min and 45 times/min respectively. The pipe with a specification of Φ25 mm*2.7-2.8 mm is then drawn into a specification of Φ21.3 mm*2.77 mm on a cold drawing machine, and the drawing rate is 1.1 m/min. The actual control ranges of sizes and tolerances of cold rolled pipes are shown in Table 4, and meet process control requirements and standard requirements.

According to the standards of ASTM A370-19e1, ASTM E18-17e1 and a method B in ASTM A923-14, samples are taken from a finished stainless steel seamless pipe at head and tail ends, a tensile sample is longitudinally sectioned, and the width of a parallel section is 19.05 mm. An impact sample is taken along a longitudinal direction of the pipe at −46° C., the size of the sample is 55*10*5 (mm), and the sample is cooled in alcohol at −46° C. for 10 min. A room temperature tensile property test, a Charpy V-type impact test at −46° C. and a hardness test are carried out for evaluation, as shown in Table 5.

| | Room temperature tensility | | | | |
|---|---|---|---|---|---|
| Mechanical properties | RP0.2/MPa | Rm/MPa | A/% | Impact energy at −46° C./J | Hardness/HRC |
| Requirements | ≥800 | ≥550 | ≥15 | ≥60 (55*10*10 mm)<br>≥30 (55*10*5 mm) | ≤32 |

-continued

| Mechanical properties | Room temperature tensility RP0.2/MPa | Rm/MPa | A/% | Impact energy at −46° C./J | Hardness/HRC |
|---|---|---|---|---|---|
| Sample 1 | 862 | 603 | 37 | 57/45/45 (55*10*5 mm) | 26/26/26 |
| Sample 2 | 869 | 604 | 36 | 57/45/45 (55*10*5 mm) | 26/26/27 |

Note:
The impact energy here is required to be the impact energy of a full-size sample (55 mm*10 mm*10 mm), and the impact energy of a small-size sample is required to be directly proportional to a ratio of a cross-sectional area of the small-size sample to a cross-sectional area of the full-size sample, and is reduced correspondingly.

Figure 2:
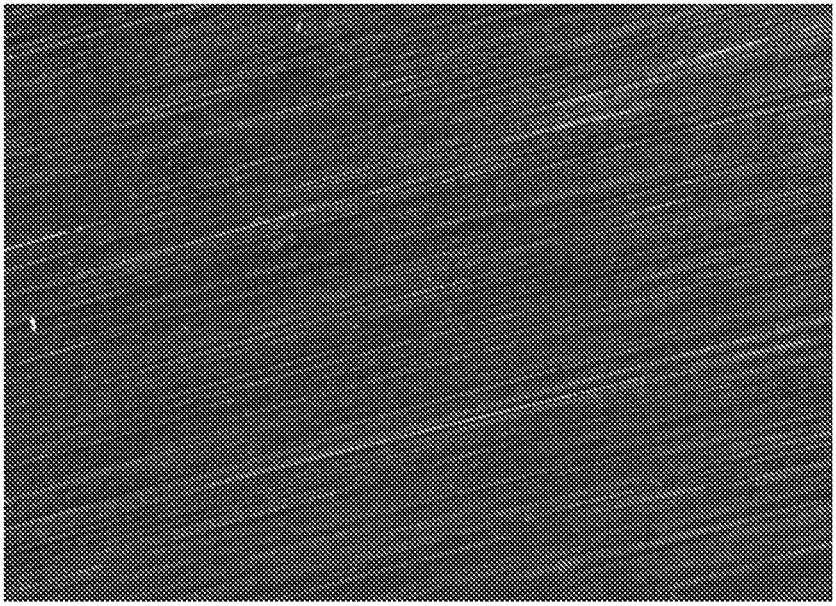
FIG. 2 is a schematic diagram of a surface of a sample after a pitting corrosion test.

A pitting corrosion test is carried out according to a method A in ASTM G48-11(2015). The size of a sample is 50*25*8.74 (mm). The sample is ground and then soaked in a ferric chloride solution of about 6% (mass ratio) at 50° C. for 24 h, and then, the weight loss before and after corrosion is calculated to obtain a corrosion rate. The calculated corrosion rate is 0.402 g/m$^2$. There are no corrosion pits on the surface of the sample under the magnification of 20 times, as shown in FIG. 2.

Figure 3:
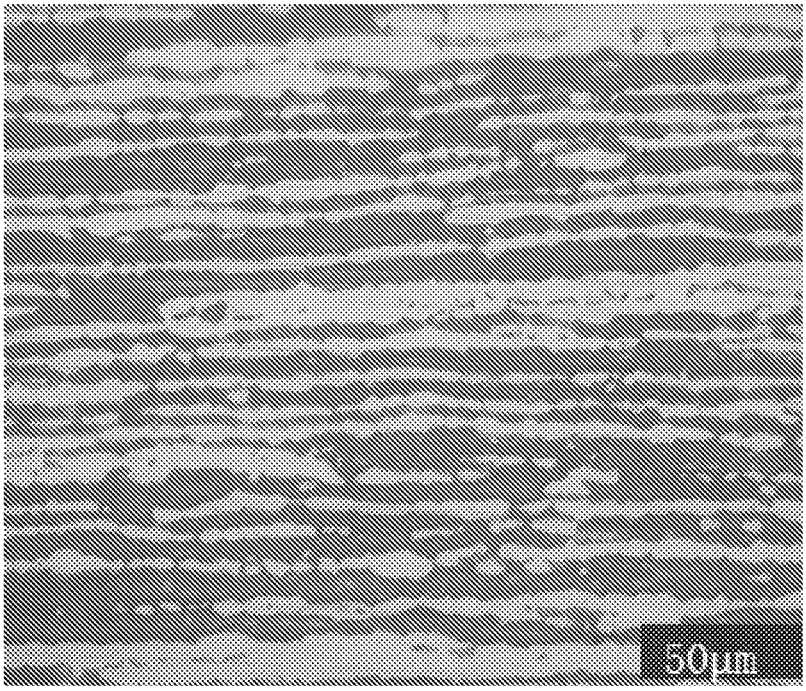
FIG. 3 is a schematic diagram of an etched surface observed and inspected under a metallographic microscope at 400 times.

According to the requirements of a method A in the ASTM A923-14 "Test Method for Detection of Harmful Intermetallic Phases of Duplex Austenitic/Ferritic Stainless Steel", a pipe is sampled, the sample is polished and then electrolyzed in a 40% sodium hydroxide solution at 1-3 V for about 15 s, the etched surface is observed and inspected under a metallographic microscope at a magnification of 400 times, the phase boundary is smooth, and there are no harmful intermetallic compounds, so the sample is an unaffected structure, as shown in FIG. 3.

Embodiment 2: The difference between Embodiment 2 and Embodiment 1 is that the nitrogen content is 0.30%, and based on the actually measured values of the contents of Cr, Mo and N elements, the PREN is calculated to be 41.95 respectively according to the formula PREN=Cr %+3.3*Mo %+16*N %.

The ferrite content is determined by point counting according to standards of ASTM E562. Ten representative fields of view are randomly selected, and the ferrite content is detected to be 55% by means of point counting.

Pierced billets with two specifications of Φ65 mm and Φ82 mm are respectively rolled into products with specifications of Φ38 mm*3.5 mm and Φ45 mm*5 mm on LG60-H and LG120-H cold rolling mills, the cold rolling feed is 3.0 mm/n, and rates of the mills are 110 times/min, 70 times/min and 40 times/min respectively. in a final pass, pipes are directly rolled into finished products with specifications of Φ25 mm*2.7-2.8 mm, Φ26.7 mm*2.87 mm, Φ33.4 mm*4.55 mm and Φ60.3 mm*8.74 mm respectively on LG30-H, LG60-H and LG120-H cold rolling mills, the cold rolling feed is 2.0 mm/n, and rates of the mills are 110 times/min, 70 times/min and 40 times/min respectively. The pipe with a specification of Φ25 mm*2.7-2.8 mm is then drawn into a product with a specification of Φ21.3 mm*2.77 mm on a cold drawing machine, and the drawing rate is 1.1 m/min. Process control requirements and standard requirements are met.

Provided is an S32750 super austenitic ferrite duplex stainless steel seamless pipe for a deep sea manifold, including the following components in percentage in mass: 0.02% of C, 0.56% of Si, 0.74% of Mn, 0.021% of P, 0.002% of S, 25.60% of Cr, 6.20% of Ni, 3.50% of Mo, 0.11% of Cu, 0.30% of N, and the balance of Fe and impurities.

The heat treatment process uses a natural gas roller hearth type solution heat treatment furnace. A preheating section is set: the temperature is 300° C.; a heating-up section is set: the set temperature is 1080° C.; a soaking section is set: the set temperature of an intermediate product is 1110° C., and the set temperature of a finished product is 1090° C.; and a cooling section is set: the cooling section is a five-stage upper and lower spray curtain cooling water apparatus, the feed is controlled by a variable-frequency speed control system and is correspondingly adjusted according to different specifications, and the rate can be adjusted at 0.6-2.0 m/min according to the actual outer diameter and wall thickness.

According to the standards of ASTM A370-19e1, ASTM E18-17e1 and a method B in ASTM A923-14, samples are taken from a finished stainless steel seamless pipe at head and tail ends, a tensile sample is longitudinally sectioned, and the width of a parallel section is 19.05 mm. An impact sample is taken along a longitudinal direction of the pipe at −46° C., the size of the sample is 55*10*5 (mm), and the sample is cooled in alcohol at −46° C. for 10 min. A room temperature tensile property test, a Charpy V-type impact test at −46° C. and a hardness test are carried out for evaluation, as shown in Table 6.

| Mechanical properties | Room temperature tensility RP0.2/MPa | Rm/MPa | A/% | Impact energy at −46° C./J | Hardness/HRC |
|---|---|---|---|---|---|
| Requirements | ≥800 | ≥550 | ≥15 | ≥60 (55*10*10 mm)<br>≥30 (55*10*5 mm) | ≤32 |
| Sample 1 | 810 | 615 | 41 | 48.5/41/34 (55*10*5 mm) | 24.6/26.3/24.9 |
| Sample 2 | 820 | 650 | 39 | 48.5/41/34 (55*10*5 mm) | 26.5/25.8/26.2 |

A pitting corrosion test is carried out according to a method A in ASTM G48-11(2015). The size of a sample is 50*25*8.74 (mm). The sample is ground and then soaked in a ferric chloride solution of about 6% (mass ratio) at 50° C. for 24 h, and then, the weight loss before and after corrosion is calculated to obtain a corrosion rate. The calculated corrosion rate is 3.11 g/m$^2$. There are no corrosion pits on the surface of the sample under the magnification of 20 times.

According to the requirements of a method A in the ASTM A923-14 "Test Method for Detection of Harmful Intermetallic Phases of Duplex Austenitic/Ferritic Stainless Steel", a pipe is sampled, the sample is polished and then electrolyzed in a 40% sodium hydroxide solution at 1-3 V for about 15 s, the etched surface is observed and inspected under a metallographic microscope at a magnification of 400 times, the phase boundary is smooth, and there are no harmful intermetallic compounds, so the sample is an unaffected structure.

Embodiment 3: The difference between Embodiment 3 and Embodiments 1 and 2 is that the nitrogen content is 0.257%, and based on the actually measured values of the contents of Cr, Mo and N elements, the PREN is calculated to be 41.58 respectively according to the formula PREN=C %+3.3*Mo %+16*N %.

The ferrite content is determined by point counting according to standards of ASTM E562. Ten representative fields of view are randomly selected, and the ferrite content is detected to be 59.4% by means of point counting.

Pierced billets with two specifications of Φ65 mm and Φ82 mm are respectively rolled into products with specifications of Φ38 mm*3.5 mm and Φ45 mm*5 mm on LG60-H and LG120-H cold rolling mills, the cold rolling feed is 3.0 mm/n, and rates of the mills are 105 times/min, 70 times/min and 40 times/min respectively. In a final pass, pipes are directly rolled into finished products with specifications of Φ25 mm*2.7-2.8 mm, Φ26.7 mm*2.87 mm, Φ33.4 mm*4.55 mm and Φ60.3 mm*8.74 mm respectively on LG30-H, LG60-H and LG120-H cold rolling mills, the cold rolling feed is 2.0 mm/n, and rates of the mills are 105 times/min, 70 times/min and 40 times/min respectively. The pipe with a specification of Φ25 mm*2.7-2.8 mm is then drawn into a product with a specification of Φ21.3 mm*2.77 mm, and the drawing rate is 1.1 m/min. Process control requirements and standard requirements are met.

Provided is an S32750 super austenitic ferrite duplex stainless steel seamless pipe for a deep sea manifold, including the following components in percentage in mass: 0.025% of C, 0.454% of Si, 0.743% of Mn, 0.020% of P, 0.001% of S, 25.617% of Cr, 6.26% of Ni, 3.592% of Mo, 0.118% of Cu, 0.257% of N, and the balance of Fe and impurities.

The heat treatment process uses a natural gas roller hearth type solution heat treatment furnace. A preheating section is set: the temperature is 300° C.; a heating-up section is set: the set temperature is 1080° C.; a soaking section is set: the set temperature of an intermediate product is 1110° C., and the set temperature of a finished product is 1130° C.; and a cooling section is set: the cooling section is a five-stage upper and lower spray curtain cooling water apparatus, the feed is controlled by a variable-frequency speed control system and is correspondingly adjusted according to different specifications, and the rate can be adjusted at 0.6-2.0 m/min according to the actual outer diameter and wall thickness. σ phase precipitation is avoided by quick cooling.

According to the standards of ASTM A370-19e1, ASTM E18-17e1 and a method B in ASTM A923-14, samples are taken from a finished stainless steel seamless pipe at head and tail ends, a tensile sample is longitudinally sectioned, and the width of a parallel section is 19.05 mm. An impact sample is taken along a longitudinal direction of the pipe at −46° C., the size of the sample is 55*10*5 (mm), and the sample is cooled in alcohol at −46° C. for 10 min.

A room temperature tensile property test, a Charpy V-type impact test at −46° C. and a hardness test are carried out for evaluation, as shown in Table 7.

| | Room temperature tensility | | | | |
|---|---|---|---|---|---|
| Mechanical properties | RP0.2/MPa | Rm/MPa | A/% | Impact energy at −46° C./J | Hardness/HRC |
| Requirements | ≥800 | ≥550 | ≥15 | ≥60 (55*10*10 mm)<br>≥30 (55*10*5 mm) | ≤32 |
| Sample 1 | 830 | 634 | 44 | 55.5/67/50 (55*10*5 mm) | 24.2/25.1/24.7 |
| Sample 2 | 832 | 650 | 39 | 55.5/67/50 (55*10*5 mm) | 25.4/25.6/26.1 |

A pitting corrosion test is carried out according to a method A in ASTM G48-11(2015). The size of a sample is 50*25*8.74 (mm). The sample is ground and then soaked in a ferric chloride solution of about 6% (mass ratio) at 50° C. for 24 h, and then, the weight loss before and after corrosion is calculated to obtain a corrosion rate. The calculated corrosion rate is 0.10 g/m$^2$. There are no corrosion pits on the surface of the sample under the magnification of 20 times.

According to the requirements of a method A in the ASTM A923-14 "Test Method for Detection of Harmful Intermetallic Phases of Duplex Austenitic/Ferritic Stainless Steel", a pipe is sampled, the sample is polished and then electrolyzed in a 40% sodium hydroxide solution at 1-3 V for about 15 s, the etched surface is observed and inspected under a metallographic microscope at a magnification of 400 times, the phase boundary is smooth, and there are no harmful intermetallic compounds, so the sample is an unaffected structure.

Non-destructive detection results are as follows:

Longitudinal and horizontal ultrasonic detection of inner and outer surfaces is performed according to NB/T20003 by using an SST-40 wireless transmission rotary ultrasonic eddy integrated combined detection device and a pulse reflective ultrasonic detection system. The depth of a rectangular groove of a standard sample is 0.1-1.0 mm, the width is not greater than 1.6 mm, and the length is not greater than 12.5 mm. The qualification rate of ultrasonic flaw detection exceeds 95%. For a nominal outer diameter of less than 65 mm, longitudinal and circular eddy flaw detection tests are performed according to the standards of NB/T20003 by using a digital eddy flaw detection system. The diameter of a through hole of a standard sample is not greater than 1.5 mm, the depth of a notch is not greater than 0.1 mm, the width is not greater than 1.5 mm, the length of the notch is not greater than 25 mm, and the qualification rate of eddy flaw detection reaches 100%.

According to the standards of ASTM E165, a penetration test is carried out on 100% pipe ends not less than 50 mm, and the inspection length of an inner surface needs to be as long as possible based on an inner diameter.

In this way, all finished stainless steel seamless pipes are subjected to a hydraulic test, the hydraulic test is carried out according to the standards of ASTM A999, the test pressure is calculated according to the formula P=2SR/D, and the qualification rate of the hydraulic test exceeds 100%.

The above description is set forth only as preferred embodiments of the present disclosure and is not intended to limit the scope of the present disclosure. Any equivalent structure or equivalent process transformation, made on the basis of the contents of the description of the present disclosure and used directly or indirectly in other related technical fields, is likewise included within the scope of the present disclosure.

What is claimed is:

1. A method for preparing a S32750 austenitic ferrite duplex stainless steel seamless pipe for a deep sea manifold comprising the following components in percentage by mass: less than or equal to 0.03% of C, less than or equal to 0.80% of Si, less than or equal to 1.20% of Mn, less than or equal to 0.035% of P, less than or equal to 0.01% of S, 24.0-26.0% of Cr, 6.0-8.0% of Ni, 3.0-5.0% of Mo, less than or equal to 0.50% of Cu, 0.24-0.32% of N, 0.012-0.018% of Al, and the balance of Fe and impurities; and a ferrite content of the S32750 austenitic ferrite duplex stainless steel seamless pipe for a deep sea manifold is 40-60%, and 41≤PREN (pitting resistance equivalent number)<45, wherein the method comprises the following steps:

a. optimization of metal components and collaborative design of two-phase ratio and PREN of steel: adjusting a two-phase ratio by adjusting the contents of ferrite and austenite elements, a content of N in the steel being 0.24-0.32%, balancing the two-phase ratio and the PREN by the content of the N element, and at the same time, enabling a formation rate and a precipitation amount of a σ phase to gradually decrease until the o phase disappears;

b. smelting of high-purity austenitic ferrite duplex stainless steel: first, performing primary smelting in an electric arc furnace (EAF) to remove impurities such as P, S and O in the steel, and adjusting a temperature of molten steel to obtain the specified components; then, performing enhanced deoxidization on Al powder in smelting in an argon oxygen decarburization (AOD) furnace to control an Al content to 0.012-0.018% and reduce an oxygen content to 11-25 ppm; finally, introducing relatively weak argon in refining outside a ladle furnace (LF), and performing stirring to remove small-size inclusions by bubbles;

c. pouring: calculating a liquidus temperature of molten steel of S32750 stainless steel, and reasonably controlling an overheating degree of pouring; controlling a solidification process by controlling a temperature field so as to effectively control macro segregation and interdendritic segregation;

d. forging: under the guidance of physical metallurgy principles and analog simulation, using natural gas heating and forging technologies to eliminate forging σ phase precipitation and phase size refinement by coupling control of a full-size temperature field and a strain field of a forged piece, so as to obtain a pipe billet with a coordinated two-phase ratio, a yield ratio not higher than 0.9 and a hardness (HRC) less than or equal to 28;

e. hot piercing: heating the pipe billet by a sloping hearth heating furnace at a heating temperature of 1150-1200° C. for 150-290 min, then, performing heat preservation for 15-50 min, after heat preservation and soaking, piercing and rolling each round steel bar by a cross piercer with a large grinding angle to obtain a pierced billet, and subsequently, performing softening at an intermediate solution heat treatment temperature; and f. cold working: manufacturing a steel pipe mainly by cold rolling supplemented with cold drawing by using a cold rolling mill for controlling deformation, implementing solution heat treatment, and controlling temperature and time to manufacture a steel pipe with the same grain size as a finished product;

wherein in step e:

i) for a pipe billet with a diameter of 65 mm, a heating temperature is 1150-1190° C., a heating time is controlled at 150-160 min, a holding time is controlled at 15-30 min, and a rotation rate of the piercer is controlled at 85-89 rpm; and for a pipe billet with a diameter of 82 mm, a heating temperature is 1160-1200° C., a heating time is controlled at 180-290 min, a holding time is controlled at 25-50 min, and a rotation rate of the piercer is controlled at 73-77 rpm;

ii) the intermediate solution heat treatment temperature is controlled at 1100-1120±10° C., a heating rate of the furnace is controlled at 2-2.5° C./s, and after the intermediate solution heat treatment temperature is reached, the holding time is controlled at 10-25 min; and iii) before the intermediate solution heat treatment, in order to ensure the quality of pickling and degreasing, corresponding acid ratio concentration and pickling time are set according to different pickling conditions, and a circulation volume of acid liquor is increased to 150 L/min during pickling; then, a multi-piece rotary cleaning apparatus is used, and a special rolling brush is fed while rolling at a rotation rate of 160-400 rpm with a back-and-forth feed of 3-10 mm/S; a surface is brushed back and forth by rolling with kerosene as a medium to remove oil dirt; finally, an endoscope is used for inspecting, the position of a defect sticking to an inner surface of the pipe is marked, and the pipe is polished by an inner hole polishing device with a 150-mesh grinding wheel to remove the defect, and then re-polished with 500-mesh sandpaper; and the intermediate solution heat treatment process is performed after the pipe passes the re-inspection by the endoscope.

2. The method for preparing the S32750 austenitic ferrite super duplex stainless steel seamless pipe for a deep sea manifold according to claim 1, wherein in step b, 3 or 5 mm deoxidization aluminum shots with an Al content of greater than or equal to 99.7% are added to the AOD furnace to ensure the deoxidization amount of the steel; after Al deoxidization, the deoxidized product exists in the molten steel in the form of $Al_2O_3$inclusions, and then, the refining slag is optimized; high-Al alkaline refining slag comprises the following components: 55-70% of CaO, 10-20% of $SiO_2$, and 15-20% of $Al_2O_3$; floating inclusions are adsorbed to reduce the content of the $Al_2O_3$ inclusions in the steel; and calcium is added to the molten steel to change the morphology of $Al_2O_3$ in the molten steel, hard and non-deformable $Al_2O_3$inclusions are transformed into plastic calcium aluminate inclusions with a low melting point and are transformed into liquid $12CaO{\cdot}7Al_2O_3$ at a steelmaking temperature, and most of the liquid calcium aluminate inclusions float out of the molten steel and are adsorbed and removed by the slag.

3. The method for preparing the S32750 austenitic ferrite duplex stainless steel seamless pipe for a deep sea manifold according to claim 2, wherein in step b, refining is performed outside the LF to form a high-content MgO and $Al_2O_3$ slag system to further remove oxygen out of the steel, then, relatively weak argon is introduced, stirring is performed to remove small-size inclusions by bubbles, and the small-size inclusions collide with each other and aggregate to form large-size inclusions, so that the inclusions float up quickly and are removed.

4. The method for preparing the S32750 austenitic ferrite super duplex stainless steel seamless pipe for a deep sea manifold according to claim 1, wherein in step b, an inner wall of an ingot mold is cleaned and kept smooth and clean, and various tiny impurities in the mold are absorbed and removed; a pouring system is made of a high-quality refractory material and needs to be cleaned; the pouring system is filled with argon in advance for protection; when the molten steel enters the mold, the protective slag ladle is heated and spread, and the volume of the molten steel is controlled to rise steadily; and during cooling and solidification of the molten steel, the feeding of a riser is sufficient to eliminate defects such as shrinkage cavities generated during pouring and cooling.

5. The method for preparing the S32750 austenitic ferrite duplex stainless steel seamless pipe for a deep sea manifold according to claim 1, wherein in step d, during high temperature forging, a forging temperature is controlled at 1110-1150° C., and an overall forging compression ratio is 3-5; after being forged, a steel ingot is returned to the furnace and further heated to reach 1130±20° C., and the temperatures of the inside and outside of the forged piece along a transverse cross section are kept consistent, so as to avoid various defects caused in a situation where the outside reaches the temperature but the inside does not reach the deformation temperature; and the heated billet is rolled into a pipe billet with a diameter of 65 mm or 82 mm in a bar mill, an outer diameter tolerance is controlled at ±0.1 mm, and an ovality is less than or equal to 0.12 mm.

6. The method for preparing the S32750 austenitic ferrite duplex stainless steel seamless pipe for a deep sea manifold according to claim 2, wherein in step f, intermediate products are respectively cold rolled into specifications of Φ38 mm*3.5 mm and Φ45 mm*5 mm, and rates of mills are 65 times/min and 45 times/min respectively; in a final pass, steel pipes are rolled into finished products with specifications of Φ25 mm*2.7-2.8 mm, Φ26.7 mm*2.87 mm, 33.4 mm*4.55 mm and 60.3 mm*8.74 mm, and rates of two mills are 100 times/min and 75 times/min respectively; and the pipe with a specification of Φ25 mm*2.7-2.8 mm is drawn into a product with a specification of Φ21.3 mm*2.77 mm.

* * * * *